US005102330A

United States Patent [19]

Ho

[11] Patent Number: 5,102,330

[45] Date of Patent: Apr. 7, 1992

[54] OPPOSED FIRED ROTARY KILN

[75] Inventor: Min-Da Ho, Somers, N.Y.

[73] Assignee: Union Carbide Industrial Gases Technology Corporation, Danbury, Conn.

[21] Appl. No.: 670,400

[22] Filed: Mar. 15, 1991

Related U.S. Application Data

[63] Continuation of Ser. No. 500,906, Mar. 29, 1990, abandoned.

[51] Int. Cl.[5] ..... F27D 7/02; F27D 9/04

[52] U.S. Cl. ..... 432/143; 432/111; 432/156; 432/105; 432/103; 110/246

[58] Field of Search ..... 432/14, 111, 103, 105, 432/156; 110/246

[56] References Cited

U.S. PATENT DOCUMENTS

| | | | |
|---|---|---|---|
| 3,404,199 | 10/1968 | Hoffmann | 432/111 |
| 3,488,700 | 1/1970 | Iken et al. | 432/111 |
| 4,345,896 | 8/1982 | Abernathy, Jr. et al. | 432/103 |
| 4,462,793 | 7/1984 | Maeda | 432/105 |
| 4,671,765 | 6/1987 | Tsai | 432/156 |
| 4,741,694 | 5/1988 | Mason et al. | 432/111 |
| 4,781,580 | 11/1988 | Janz et al. | 432/111 |
| 4,834,648 | 5/1989 | Angelo II | 432/103 |
| 4,863,371 | 9/1989 | Ho | 431/9 |

OTHER PUBLICATIONS

Chemical Engineering, Dec. 1989, pp. 79–81.

Sulzer, et al., Application of Thermal Destruction Technology to the Cleanup of Contaminated Soils, HWHM '88, Apr. 19, 1988, pp. 131–135.

*Primary Examiner*—Henry C. Yuen

*Attorney, Agent, or Firm*—Stanley Ktorides

[57] ABSTRACT

A rotary kiln system wherein oxidant injection means are positioned at each stationary end and inject oxidant toward each other creating gas recirculation within the rotary kiln for improved mixing, combustion efficiency and temperature uniformity.

27 Claims, 5 Drawing Sheets

OPPOSED FIRED ROTARY KILN

This application is a continuation of prior U.S. application Ser. No. 500,906 filing date Mar. 29, 1990 now abandoned.

TECHNICAL FIELD

This invention relates generally to rotary kilns and is particularly useful with mobile rotary kilns.

BACKGROUND ART

A rotary kiln is a refractory-lined cylindrical vessel commonly used, for example, in the incineration of waste, in the calcining of cement, coke or other materials, in the firing of ceramic, and in many other uses. In the incineration of waste, the waste is provided into the kiln and is combusted while passing through the kiln by the combustion fuel and oxidant which is injected into the rotary kiln at one end of the kiln. The injection of the fuel and oxidant into the kiln may be either concurrent with the flow of waste or other material through the kiln, or it may be countercurrent to the flow of waste or other material through the kiln. Gases from within the kiln are removed through a flue located at one end of the kiln. After the waste has passed through the kiln, ash from the combusted waste is removed from the kiln.

In a countercurrent kiln the hot combustion gases and excess air are carried through the kiln first volatizing combustibles from the waste. These combustibles are combusted generating additional heat flowing countercurrently to the flowing waste which further dries the waste. It is imperative that the furnace gases contain sufficient mass to absorb the heat release without overheating which can cause refractory damage to the kiln or kinetically favor the generation of nitrogen oxides ($NO_x$). Accordingly the throughput of material, such as waste, through the kiln is limited by the quantity of furnace gases generated within the kiln by the injected fuel and oxidant, and by the combusting volatiles if volatiles are present, and also by the rate at which heat can be transferred to wet material or to other heat sinks by the furnace gases.

In a concurrent kiln another problem arises in that the heat released from volatile combustibles is passing away from the wet material heat sink. An auxiliary burner is generally required to provide extra heat to the drying zone to dry the material so as to enable volatization of the volatile combustibles. This increases the volumetric flowrate of the gases passing out the flue increasing particulate carryover and burden on the air pollution devices thus limiting the throughput through the kiln.

The mismatch of heat source and heat sink which creates throughput limitations for both countercurrent and concurrent rotary kilns is more severe for long rotary kilns, such as kilns having a length to diameter (L/D) ratio exceeding 4.

A recent use for rotary kilns which has been gaining wide acceptance has been in the incineration of hazardous waste. A particularly advantageous rotary kiln for this application is a mobile or transportable rotary kiln which can be transported to the hazardous waste site and then removed when the hazardous waste site has been cleaned. Unfortunately a mobile rotary kiln is by necessity smaller than a stationary rotary kiln in order to enable transportability. Thus the throughput limitations discussed above are even more acute in the case of a mobile rotary kiln.

Accordingly it is an object of this invention to provide a rotary kiln having increased throughput over conventional rotary kilns without causing high potential for refractory damage or creating conditions highly favorable for $NO_x$ formation.

It is another object of this invention to provide a method for operating a rotary kiln so as to increase throughput over that obtainable with conventional rotary kiln operating methods without causing high potential for refractory damage or creating conditions highly favorable for $NO_x$ formation.

SUMMARY OF THE INVENTION

The above and other objects which will become apparent to one skilled in the art upon a reading of this disclosure are attained by the present invention one aspect of which is:

A rotary kiln comprising:

(A) a rotatable cylindrical body having an internal diameter;

(B) a nonrotatable wall at each end of the rotatable cylindrical body;

(C) flue means at one end of the rotatable cylindrical body;

(D) a first oxidant injection means positioned within the nonrotatable wall at the end opposite to the flue end, said first oxidant injection means oriented to inject oxidant into the rotatable cylindrical body toward the flue end; and (E) a second oxidant injection means positioned within the nonrotatable wall at the flue end, said second oxidant injection means oriented to inject oxidant into the rotatable cylindrical body toward the end opposite the flue end and adapted to inject the oxidant with a momentum sufficient to pass through a length equal to at least two times the internal diameter of the rotatable cylindrical body.

Another aspect of this invention comprises:

A method for operating a rotary kiln comprising:

(A) providing feed comprising volatile material into a rotatable cylindrical body;

(B) removing gas from the rotatable cylindrical body through a flue at one end of the rotatable cylindrical body;

(C) injecting oxidant into the rotatable cylindrical body at the end opposite the flue end in the direction of the flue end to create a flow of gas toward the flue end;

(D) injecting oxidant into the rotatable cylindrical body at the flue end in the direction of the end opposite the flue end having a momentum at least equal to that of gas flowing toward the flue end; and (E) volatizing material from the feed within the rotatable cylindrical body.

As used herein the term "cylindrical" means tubular, generally but not necessarily having a circular radial cross-section.

As used herein, the term "waste" means any material intended for partial or total combustion within a combustion zone.

As used herein the term "burner" means a device through which both oxidant and combustible matter are provided into a combustion zone either separately or as a mixture.

As used herein the term "lance" means a device through which either oxidant or combustible matter but not both is provided into a combustion zone.

As used herein the term "recirculation ratio" means the ratio of the mass flowrate of material recirculated back toward the periphery of a jet to the mass flowrate of the total fluid injected into a combustion zone.

As used herein the term "combustible" means a substance that will burn under combustion zone conditions.

As used herein the term "incombustible" means a substance that will not burn under combustion zone conditions.

As used herein the term "volatile" means a material which will pass into the vapor state under combustion zone conditions such as, for example, the vapor materials resulting from drying, or from the decomposition or thermal dissociation of solid or liquid materials.

As used herein the term "equivalent diameter" means that diameter of a single circular orifice which would provide the same total area as the sum of the areas of a multi-orifice injection means.

DETAILED DESCRIPTION

The invention enables a significant increase in rotary kiln throughput by maintaining a desirable temperature profile throughout the kiln. This reduces large temperature gradients through the kiln reducing the need for a high temperature in one part of the kiln in order to provide heat to another part of the kiln. In addition the need for auxiliary fuel combustion to provide heat to a drying zone within the kiln is reduced. Thus throughput limitations caused by localized hot temperatures or flue gas flowrates are relaxed.

The invention will be described in detail with reference to the Drawings.

Figure 1:
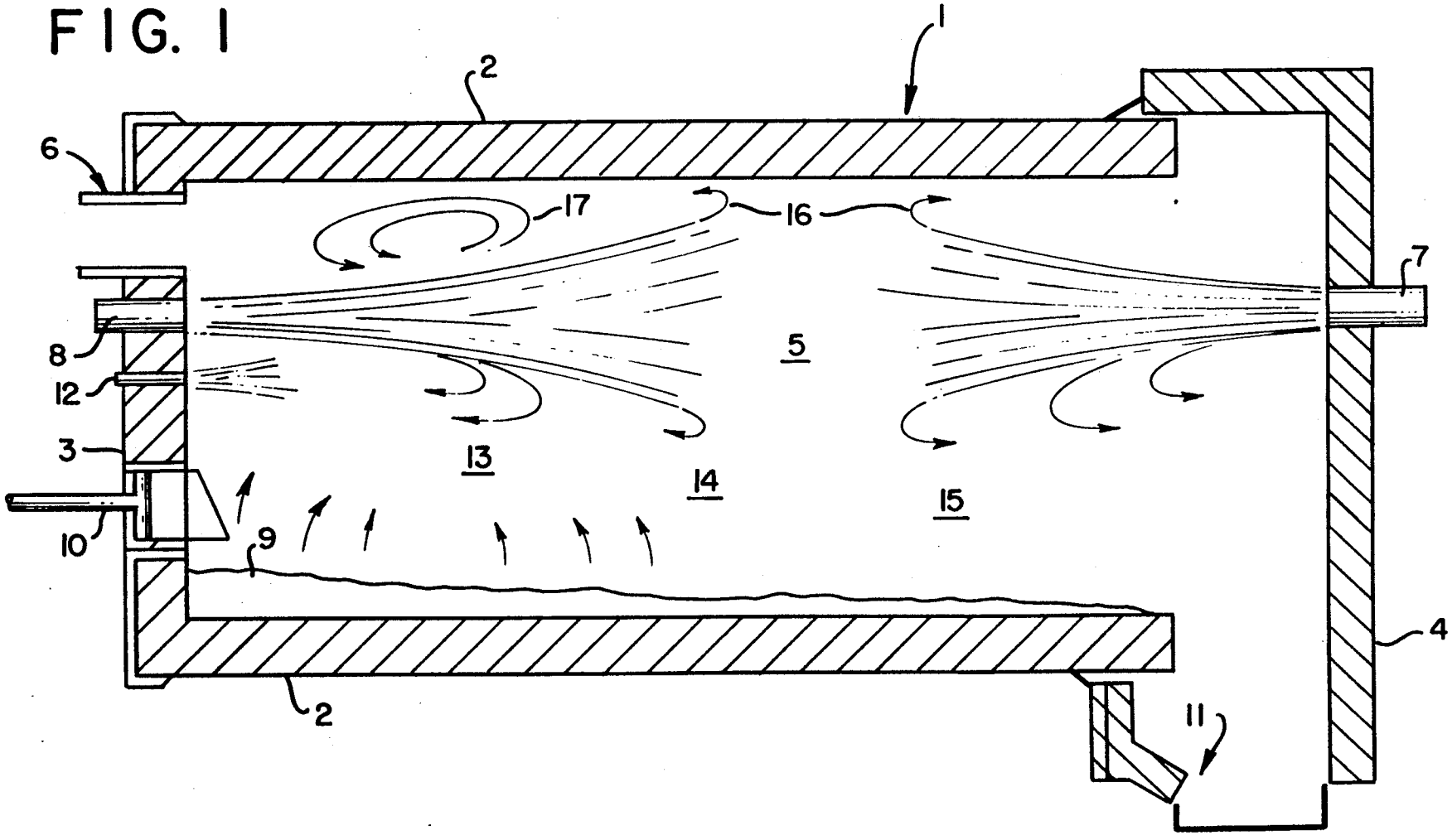
FIG. 1 is a schematic representation of one embodiment of the invention carried out in conjunction with waste incineration within a countercurrent kiln.

Referring now to FIG. 1, there is illustrated rotary kiln 1 having a rotatable cylindrical body 2, and nonrotatable walls 3 and 4 at each axial end of the rotatable cylindrical body to define a combustion zone 5. Preferably the kiln has a length to diameter ratio exceeding 4 but less than 8.

Flue 6 is positioned at one axial end of rotatable cylindrical body 2. Although shown in FIG. 1 as having a horizontal orientation, the flue may have a vertical or any other suitable orientation. A first oxidant injection means such as first burner 7 is positioned within nonrotatable wall 4 opposite the end having flue 6. First burner 7 is oriented to inject fuel and oxidant into combustion zone 5 within rotatable cylindrical body 2 in a direction toward the flue end. Second oxidant injection means such as second burner 8 is positioned within nonrotatable wall 3 at the flue end and is oriented to inject fuel and oxidant into combustion zone 5 in a direction toward the end opposite the flue end. Alternatively either or both of the first and second oxidant injection means may be a lance, such as lance 12. In such a case only oxidant is provided into the combustion zone from a lance.

The second oxidant injection means which injects oxidant into the kiln in the direction away from the flue end is adapted to inject the oxidant with a momentum sufficient to pass through the kiln a length equal to at least two times the internal diameter of, and preferably at least 50 percent of the length of, the rotatable cylindrical body. One means of accomplishing this high momentum is by the injection of the oxidant through a restricted orifice having a diameter, or multiple orifices having an equivalent diameter, not exceeding 1/30 of the kiln internal diameter and preferably not exceeding 1/100 of the kiln internal diameter. The restricted orifice imparts a high velocity to the oxidant as defined by Bernoulli's equation, and the high velocity causes the momentum to increase since momentum is the product of mass and velocity. Another means of accomplishing high momentum is by increasing the mass of the second oxidant. However, this is not preferable because this simultaneously increases the mass and the momentum of the gas flowing toward the flue end.

Figure 4:
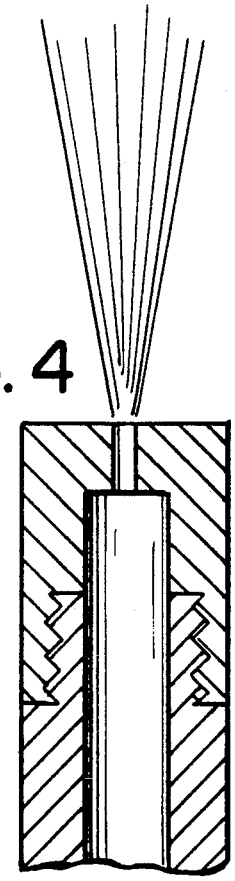
FIG. 4 is an illustration of a single orifice oxidant injection means for injecting oxidant with a high momentum into a kiln at the flue end.
Figure 5:
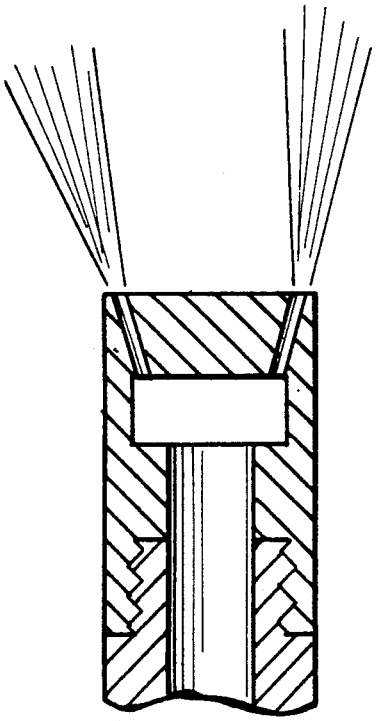
FIG. 5 is an illustration of a multi-orifice oxidant injection means for injecting oxidant with a high momentum into a kiln at the flue end.
Figure 6:
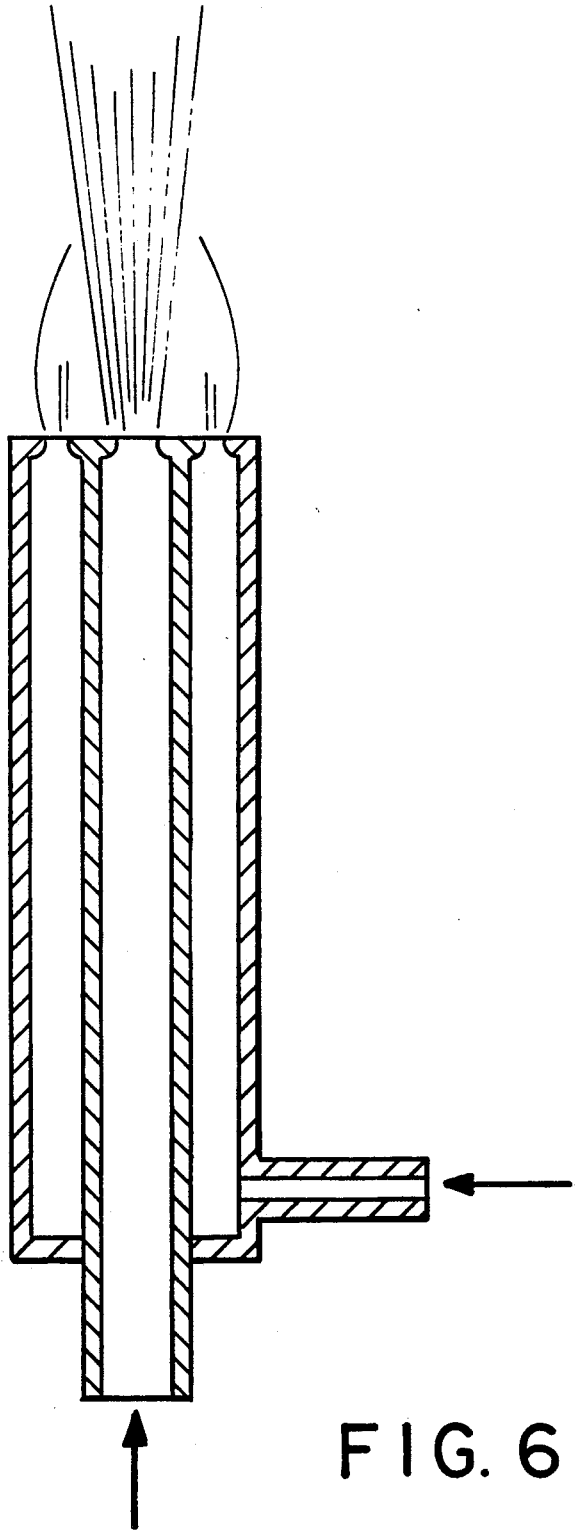
FIG. 6 is an illustration of a burner which may be used in the practice of this invention.

FIGS. 4, 5 and 6 illustrate such second oxidant injection means. Referring to FIG. 4 there is illustrated a single orifice nozzle having a restricted diameter for the injection of oxidant. FIG. 5 illustrates a multiple orifice nozzle having an equivalent diameter of the defined restriction to enable the attainment of the required high momentum. FIG. 6 illustrates a burner wherein oxidant and fuel may be injected through concentric tubes to produce oxidizing gas. Oxidant may be fed through the center tube and fuel may be fed through the outer annular passage or vice versa. The center tube may be fitted with a single or a multiple orifice nozzle.

Figure 7:
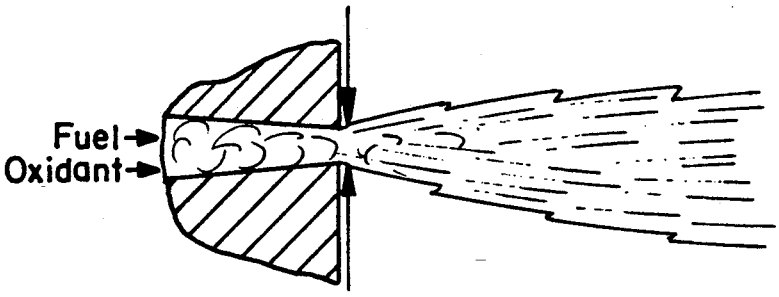
FIG. 7 is an illustration of a means to react fuel and oxidant in a recessed cavity prior to injection into the kiln.

In anther embodiment illustrated in FIG. 7, one can cause oxidant and some fuel to react and expand within a cavity recessed within the kiln wall. The cavity provides a restriction so that the hot combustion products at near the adiabatic flame temperature of the mixture leave the cavity at a high velocity. In this case the cavity would have a diameter at the point of communication with the kiln of less than 1/10 of the kiln internal diameter.

In operation, feed, such as waste 9, comprising volatile material is provided into combustion zone 5, such as through ram feeder 10, to form a bed which flows through the combustion zone. Other feeds which be used with this invention include cement, coke, ceramic and other materials which include a volatile component such as water. The method of this invention will be described in detail with waste as the feed which may include volatile combustible and volatile incombustible matter. Waste may be liquid and/or solid waste such as is defined in the Resource Conservation Recovery Act (RCRA) or the Toxic Substances Control Act (TSCA). The waste passes sequentially through a drying zone 13 wherein it is dried of volatile incombustible matter such as water and some of the lighter volatile combustible matter, a pyrolysis zone 14 wherein additional combustible matter is volatized out, and a char burnout zone 15 wherein the residual solids are combusted. Resulting ash is removed from combustion zone 5 through ash removal door 11. As is appreciated by one skilled in the art, there is not a clear demarcation between these zones. In FIG. 1 the arrows indicate the volatization of incombustible and combustible matter in zones 13 and 14 respectively.

Fuel and oxidant are injected through burner 7 into combustion zone 5 wherein they are combusted to provide heat to the combustion zone to carry out the drying, pyrolyzing and burning of the waste discussed above. The oxidant may be air, technically pure oxygen having an oxygen concentration greater than 99.5 percent, or oxygen-enriched air having an oxygen concentration of at least 25 percent and preferably greater than 30 percent. The fuel may be any suitable fluid fuel such as natural gas, propane, fuel oil, or liquid waste.

The combustion of the fuel and oxidant injected into combustion zone 5 through first burner 7, and the combustion of the volatile combustibles evaporated from the waste, create a flow of gas toward the flue end. Gas is removed from combustion zone 5 through flue 6.

Fuel and oxidant are injected into combustion zone 5 through second burner 8 and can be defined the same as the fuel and oxidant injected through first burner 7. The fuel and oxidant injected through burner 8 is injected having a momentum at least equal to, and preferably greater than 200 percent of, the momentum of the gas flowing toward the flue end. The gas flowing toward the flue end may include fuel and oxidant injected through the first burner and the combustion products thereof, water vapor, combustion products from the material injected through the second burner, and combustion products from the combustion of volatized combustible material. As is known, momentum is equal to the mass times the velocity of the fluid. In this way the combustion reaction stream injected through burner 8 penetrates a significant distance into combustion zone 5, preferably at least two kiln diameters. Heat released from the combustion of the fuel and oxidant injected into combustion zone 5 through burner 8 serves to provide heat for the aforedescribed drying, pyrolyzing and burning of the waste.

The arrangement of the invention wherein burners fire opposed to one another causes the temperature within the combustion zone to be much more uniform than with conventional rotary kiln arrangements because the two injected combustion streams tend to cause each other to recirculate through the combustion zone as indicated by the reversing flow arrows 16 in FIG. 1, although only the recirculation of the gas flowing from the flue end is necessary for the successful operation of the invention. Furthermore, the high momentum of the flue end combustion stream causes enhanced recirculation as shown by arrows 17. In this way temperature gradients within the kiln are better controlled so throughput limitations based on heat transfer rate considerations or flue gas flowrate considerations are relaxed. In addition, the high momentum flame may be manipulated to enhance local radiative and convective heat transfer to the load when desired.

In a preferred operating method either or both of the oxidant streams injected through oxidant injection means 7 and 8 are injected at a high velocity so as to provide a recirculation of gases within the combustion zone, preferably to provide a recirculation ratio exceeding 4. Preferably the oxidant stream velocity exceeds 150 feet per second. In this way the temperature uniformity within combustion zone 5 is enhanced. This is particularly the case for the oxidant stream injected through first burner 7 so that, as illustrated in FIG. 1, the gases do not merely pass through combustion zone 5, but rather recirculate one or more times within combustion zone 5 so as to enhance mixing and combustion efficiency within combustion zone 5 and thus further enhance temperature uniformity within each of the two recirculation zones at the two parts of the combustion zone.

Figure 2:
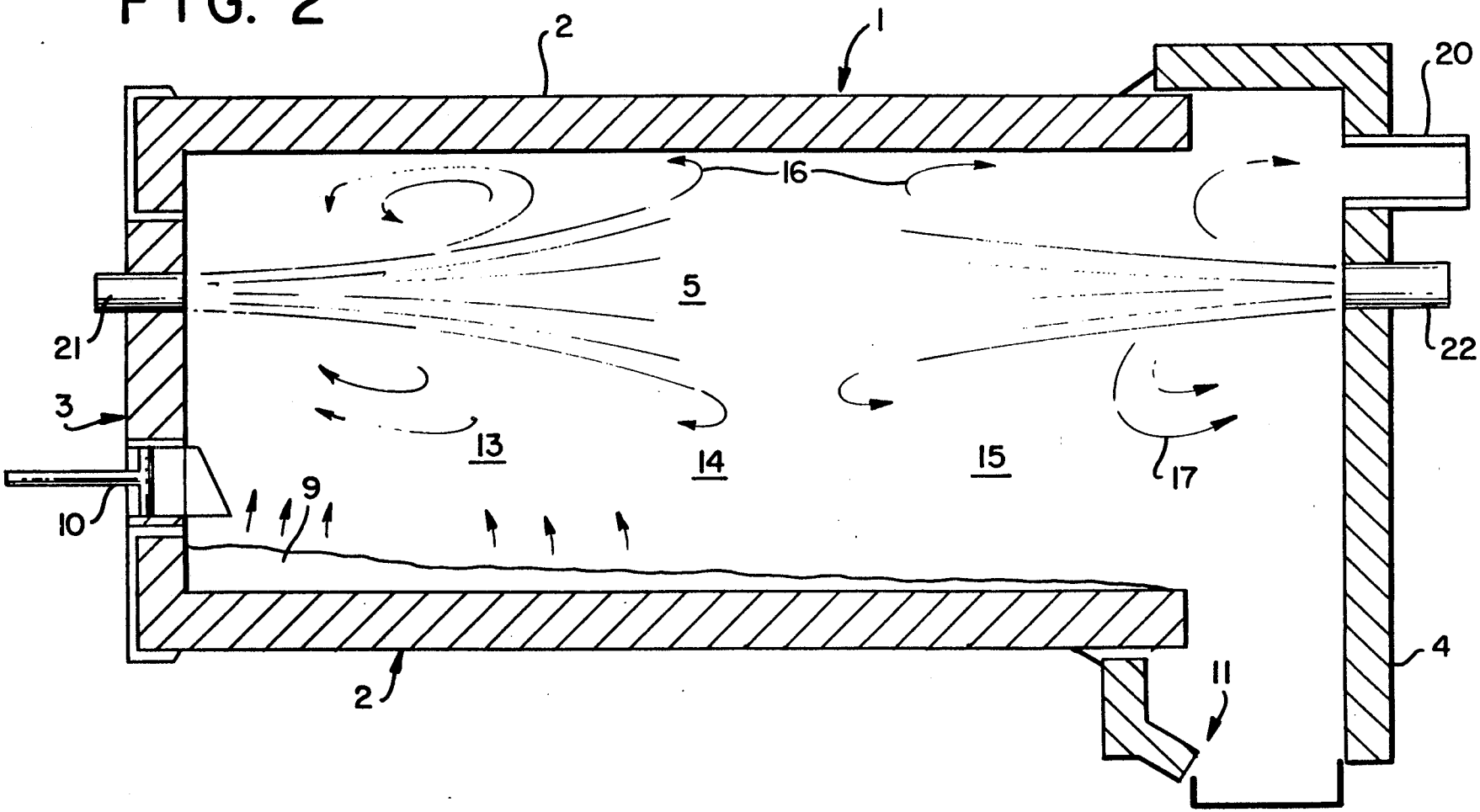
FIG. 2 is a schematic representation of another embodiment of the invention carried out in conjunction with waste incineration within a concurrent kiln.
Figure 3:
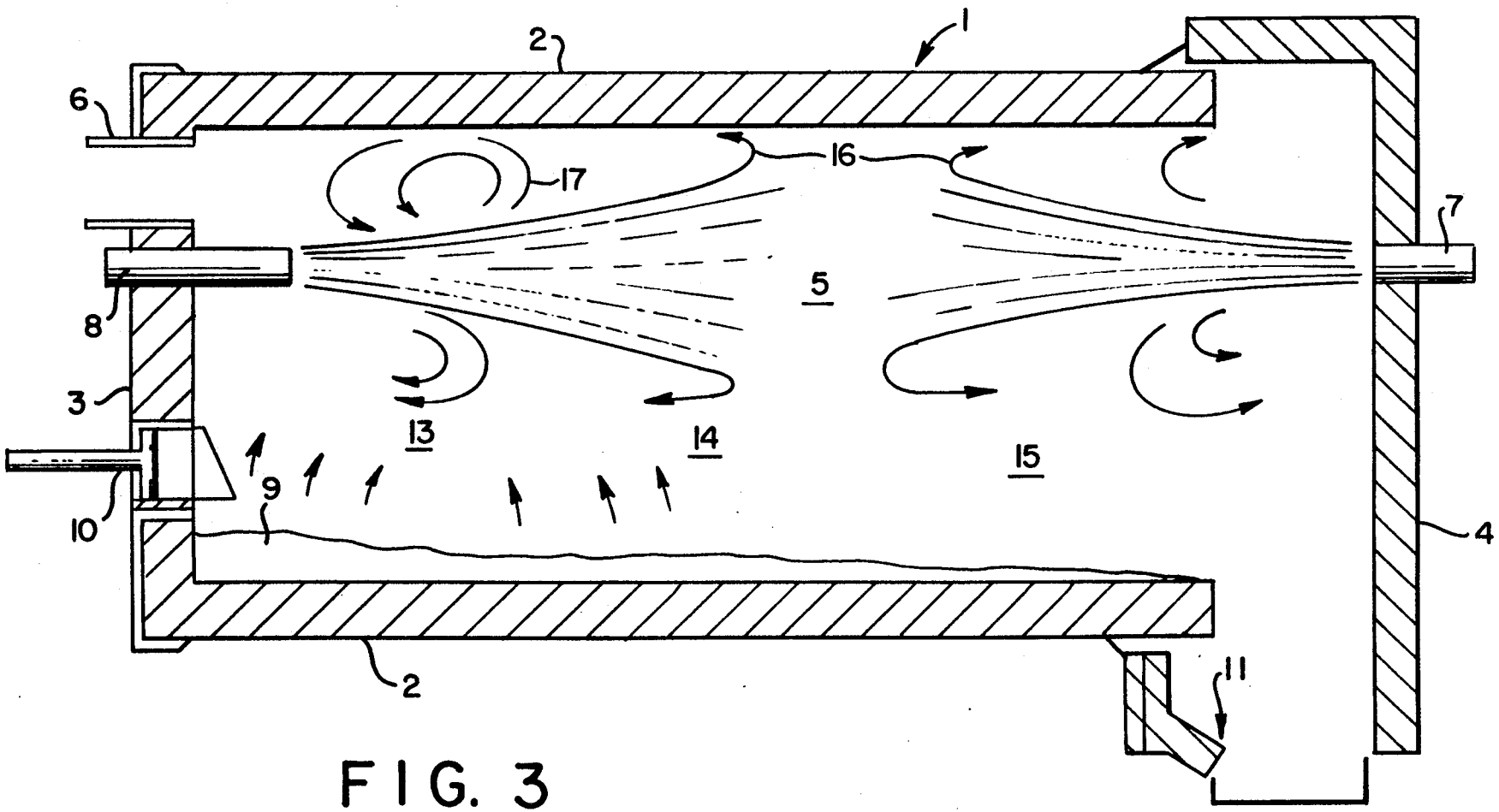
FIG. 3 is a schematic representation of another embodiment of the invention illustrating the invention carried out with a plug flow zone.

In an alternative arrangement, the injection end of the second oxidant injection means located at the flue end protrudes a distance into the combustion zone as illustrated in FIG. 3 rather than having its injection end flush with the wall within which it is positioned as is illustrated in FIGS. 1 and 2. The numerals in FIG. 3 correspond to those of FIG. 1 for the common elements. In this way a plug flow zone is establish immediately before the flue. In a plug flow zone there is very little backmixing or recirculation of gases. In the more quiescent plug flow region, the gas velocity is reduced due to the lack of recirculation flow. Therefore, airborne particulates have the opportunity to settle down from the gas stream. Also the gas is allowed to cool down somewhat, resulting in reduced gas velocity. The protrusion can be as long as practical and typically is about one kiln diameter.

In a countercurrent kiln it may be desirable to inject additional oxidant, such as technically pure oxygen, into the combustion zone at the flue end in order to carry out further combustion in the drying zone. This is particularly the case where a large amount of combustibles are volatized from the feed and are carried into the drying zone by the flowing gases resulting in pyrolytic or fuel-rich conditions in the drying zone. The additional oxidant may be injected through burner 8 or through lance 12 depending on which is used as the second oxidant injection means.

The invention enables the kiln operator to operate the combustion zone of the rotary kiln with two separate combustion control zones at each end of the kiln. In addition to stoichiometric operation, the combustion control zone at each end of the kiln may be operated with pyrolytic (fuel-rich) or oxidating (oxygen-rich) conditions thus adding flexibility to the kiln design and to the combustion process control. For example, especially with the processing of high-BTU waste, the combustion control zone at the flue end of a countercurrent rotary kiln can be run in the pyrolytic mode so that combustible gases released from the waste are recirculated and entrained into the high momentum stream from the flue end burner thus consuming the oxidant. Residue char in the combustion control zone at the other end of the kiln can be exposed to oxidating conditions to complete the burnout.

In the method of this invention the use of oxygen enrichment serves to decrease the momentum of the gases flowing toward the flue thus enabling easier flue end injection into the kiln, and also serves to decrease the volumetric flowrate of gases flowing through the flue thus increasing throughput. Accordingly the lower the percentage of inert nitrogen introduced into the combustion zone with the oxidant, the more advantageous will be the operation of the method of this invention. Thus, to achieve maximum throughput, the most preferred oxidant is technically pure oxygen, air inleakage notwithstanding.

FIG. 2 illustrates the rotary kiln and operating method of this invention carried out with the incineration of waste in a concurrent kiln. The numerals in FIG. 2 correspond to those of FIG. 1 for the common elements. In the embodiment illustrated in FIG. 2, flue 20 is located at the end opposite the end at which waste is provided into the kiln. First oxidant injection means such as a lance or burner 21 is positioned within nonrotatable wall 3 at the end opposite the flue end and second oxidant injection means such as a lance or burner 22 is positioned within nonrotatable wall 4 at the flue end. Oxidant injection means 21 and 22 inject oxidant toward the wall opposite from where they are positioned. The operation of the rotary kiln illustrated in FIG. 2 is similar to that of the kiln illustrated in FIG. 1 except that the flow of gases toward the flue end is concurrent with, not countercurrent to, the flow of waste sequentially through the drying, pyrolyzing and char burning zones.

In a conventional rotary kiln used to incinerate hazardous waste, hazardous fumes released from the waste may not always pass through the flame region of the combustion zone. For a conventional countercurrent rotary kiln the fumes may not even be exposed to a high temperature within the kiln. Accordingly conventional incineration systems employing rotary kilns depend in great measure on a secondary combustion chamber for the destruction of hazardous constituents. However with the system of this invention wherein opposed fired burners cause extensive gas recirculation within the combustion zone, fumes volatized from the waste pass several times through the flame region thus increasing the destruction efficiency of the hazardous constituents. This may, in some cases, eliminate the need for a secondary combustion chamber in the incineration of hazardous waste.

The invention enables the operation of a rotary kiln with improved control by enabling independent or separate adjustment of the oxidant and fluid fuel injected at the flue end and at the end opposite the flue end. This is particularly advantageous when these two oxidants have differing oxygen concentrations, e.g. air and technically pure oxygen.

For example, one may determine the volumetric flowrate of the gas being removed through the flue. As used herein the term "determine" means any way of arriving at a value including measuring, calculating or estimating the value. The flowrate may then be compared with a predetermined desired flowrate and the flowrate ratio of the oxidants may then be adjusted, i.e. changed, so that the determined flowrate changes in the direction toward the desired flowrate. Because of the high momentum of the oxidant injected at the flue end which passes significant gas flow away from the flue into the kiln, as opposed to prior art processes, changes in flue gas flowrate can be accomplished with changes in the flowrate ratio of the injected oxidants while being able to maintain a desirable temperature profile and furnace atmosphere.

In another example, one may determine the pressure within the rotatable cylindrical body. Typically when waste is being incinerated the pressure within the kiln is desired to be a negative pressure. The determined pressure may then be compared with a predetermined desired pressure and the flowrate ratio of the oxidants may then be adjusted so that the determined pressure changes in the direction of the desired pressure while maintaining a desirable temperature profile and furnace atmosphere.

In another method for improving the control of the operation of the rotary kiln, one may determine the heat demand at both the flue end zone and at the end zone opposite the flue end and adjust the flow of one or both of the oxidants and fluid fuel, if necessary, to accommodate the heat demands simultaneously.

As can be seen any operating parameter may be determined, compared with a predetermined desired value for that parameter, and the total flowrate and the flowrate ratio of the oxidants may be adjusted so that the determined value of the parameter changes in the direction toward the desired value for that parameter. As indicated earlier this advantageous control based on changing the total flowrate and the ratio of the oxidants is due to the high momentum of the flue end injected oxidant which doesn't merely affect the proximity of the flue end as in conventional processes, but rather has a marked effect on the gas flow pattern within the kiln. A significant advantage of the invention is the ability to independently control temperature or heat release and atmosphere at each end of the kiln while simultaneously controlling gas flowrate or pressure in the kiln.

Temperature within the kiln may also be controlled or moderated by the injection of water, especially as an atomized stream, into the kiln.

The following examples are provided for illustrative purposes and are not intended to limiting.

EXAMPLE 1

A scaled-down cold flow model of a rotary kiln similar to that illustrated in FIG. 3 was employed. The kiln model had a length of 3.5 feet and an L/D ratio of 7. A nozzle injected gas toward the flue end at a volumetric flowrate of 7380 cubic feet per hour (CFH) and a burner fired away from the flue end with a high velocity jet injected at a volumetric flowrate of up to 670 CFH wherein the initial velocity of the jet was about 1000 feet per second. The momentum of the flow from the burner ranged between 100 to 500 percent of the momentum of the gases flowing toward the flue. The flow from the flue end jet penetrated up to 63.3 percent of the length of the kiln. Recirculation gas flow within the kiln flue end was vigorous.

EXAMPLE 2

A countercurrent rotary kiln similar to that illustrated in FIG. 3 is employed having a length of 45 feet and an internal diameter of 6.5 feet. Oxygen at a flowrate of 4092 lb/hr and natural gas at a flowrate of 1066 lb/hr, having a heat value of 22,991 BTU/lb, are injected at a high momentum into the kiln at the flue end through a burner extending 5 feet into the kiln. Air at a flowrate of 11,000 lb/hr and natural gas at a flowrate of 613 lb/hr are injected into the kiln through a burner at the end opposite the flue end. The kiln is operated at negative pressure and ambient air leaks into the kiln at a flowrate of 5500 lb/hr. Soil comprising hazardous waste and having a water content of 15 percent but no heating value is passed into the kiln at the flue end at the rate of 25 tons per hour. Ash is removed from the kiln at a temperature of 900° F. at a flowrate of 42,494 lb/hr and gas is passed out of the kiln through the flue at the rate of 29,777 lb/hr (30,630 actual cubic feed per minute) at a temperature of 1600° F. and having an oxygen concentration of 3.1 percent.

With the air fired burner firing alone, the maximum soil processing rate is only 16 tons per hour while meeting the required ash temperature of 900° F. Moreover with oxygen enrichment at the discharge end and without the oxygen burner firing toward the discharge end, the flame is shortened and the combustion gas temperature gradient is significantly increased so that, at an increased throughput, the soil does not undergo sufficient residence time at the elevated temperature to undergo a detoxification reaction.

Although the invention has been described in detail with reference to certain embodiments those skilled in the art will recognize that there are other embodiments of the invention within the spirit and scope of the claims.

I claim:

1. A method for operating a rotary kiln comprising:
(A) providing feed comprising volatile material into a rotatable cylindrical body;
(B) removing gas from the rotatable cylindrical body through a flue at one end of the rotatable cylindrical body;
(C) injecting oxidant into the rotatable cylindrical body at the end opposite the flue end in the direction of the flue end to create a flow of gas toward the flue end;
(D) injecting oxidant from a single injection means into the rotatable cylindrical body at the flue end in the direction of the end opposite the flue end having a momentum at least equal to that of gas flowing toward the flue ned penetrating into the rotatable cylindrical body a distance at least equal to two diameters of the rotatable cylindrical body causing recirculation within the rotatable cylindrical body;
(E) volatizing material from the feed within the rotatable cylindrical body; and
(F) carrying out combustion within the rotatable cylindrical body in a flame region and causing material volatized from the feed to pass by said recirculation through the flame region.

2. The method of claim 1 wherein feed is provided into the rotatable cylindrical body at the same end as that where gas is removed through the flue.

3. The method of claim 1 wherein feed is provided into the rotatable cylindrical body at the end opposite to the end where gas is removed through the flue.

4. The method of claim 1 wherein the oxidant injected in step (D) penetrates into the rotatable cylindrical body a distance at least equal to two diameters of the rotatable cylindrical body.

5. The method of claim 1 wherein the feed is waste comprising combustible material.

6. The method of claim 5 additionally comprising combusting volatized combustible material from the waste within the rotatable cylindrical body.

7. The method of claim 5 wherein the feed comprises water as a volatile material.

8. The method of claim 1 wherein at least one of the oxidant injected into the rotatable cylindrical body in steps (C) and (D) is technically pure oxygen.

9. The method of claim 1 wherein at least one of the oxidant injected into the rotatable cylindrical body in steps (C) and (D) is oxygen-enriched air having an oxygen concentration of at least 25 percent.

10. The method of claim 1 wherein the oxidant injected into the rotatable cylindrical in step (C) is air and the oxidant injected into the rotatable cylindrical body in step (D) is technically pure oxygen.

11. The method of claim 1 wherein the oxidant injected into the rotatable cylindrical body in step (D) is injected flush with a wall at that end.

12. The method of claim 1 wherein the oxidant injected into the rotatable cylindrical body in step (D) is injected extending from a wall at that end.

13. The method of claim 1 wherein fuel is injected with the oxidant in step (C).

14. The method of claim 1 wherein fuel is injected with the oxidant in step (D).

15. The method of claim 1 wherein combustion is carried out at at least one of the flue end and the end opposite the flue end under pyrolytic conditions.

16. The method of claim 1 wherein combustion is carried out at at least one of the flue end and the end opposite the flue end under oxidating conditions.

17. The method of claim 1 wherein combustion is carried out at the flue end under pyrolytic conditions and combustion is carried out at the end opposite the flue end under oxidating conditions.

18. The method of claim 1 further comprising determining the volumetric flowrate of the gas being removed through the flue, comparing the determined flowrate with a predetermined desired flowrate, and adjusting the volumetric flowrate ratio of the oxidant injected in step (C) and the oxidant injected in step (D) so that the flue gas volumetric flowrate changes toward the desired flowrate.

19. The method of claim 1 further comprising determining the pressure within the rotatable cylindrical body, comparing the determined pressure with a predetermined desired pressure, and adjusting the volumetric flowrate ratio of the oxidant injected in step (C) and the oxidant injected in step (D) so that the pressure within the rotatable cylindrical body changes toward the desired pressure.

20. The method of claim 1 further comprising determining the heat demand at the flue end and also at the end opposite the flue end, and adjusting the flow of at least one of the oxidant injected in step (C) and the oxidant injected in step (D) to accommodate the determined heat demands.

21. The method of claim 1 wherein the oxidant injected in step (C) and the oxidant injected in step (D) have different oxygen concentrations.

22. The method of claim 1 further comprising determining the value of an operating parameter, comparing the determined value with a predetermined desired value for that parameter, and adjusting the volumetric flowrate ratio of the oxidant injected in step (C) and the oxidant injected in step (D) so that the determined value changes toward the desired value.

23. The method of claim 1 further comprising independently controlling the temperature and atmosphere at each end of the rotatable cylindrical body while simultaneously controlling the gas flowrate into the rotatable cylindrical body.

24. The method of claim 1 wherein the oxidant injected into the rotatable cylindrical body in step (D) is introduced into a cavity recessed from the wall at that end and thereafter passed from the cavity into the rotatable cylindrical body.

25. The method of claim 24 wherein some oxidant combusts with fuel within the cavity.

26. The method of claim 1 wherein the oxident injected in step (D) is oxidizing gas generated from a burner.

27. The method of claim 1 further comprising injecting water into the rotatable cylindrical body.

* * * * *

UNITED STATES PATENT AND TRADEMARK OFFICE

CERTIFICATE OF CORRECTION

PATENT NO. : 5,102,330

DATED : April 7, 1992

INVENTOR(S) : M. Ho

It is certified that error appears in the above-identified patent and that said Letters Patent is hereby corrected as shown below:

Col. 9

In claim 1, line 15 delete "ned" and insert therefor -- end --.

Signed and Sealed this

Twenty-first Day of September, 1993

Bruce Lehman

*Attest:*

BRUCE LEHMAN

*Attesting Officer*

*Commissioner of Patents and Trademarks*